US012215443B2

(12) United States Patent
Konukoğlu et al.

(10) Patent No.: US 12,215,443 B2
(45) Date of Patent: Feb. 4, 2025

(54) YARN COMPRISING A CORE AND A SHEATH OF FIBERS

(71) Applicant: Sanko Tekstil Isletmeleri San. Ve Tic. A.S., Inegol (TR)

(72) Inventors: Fatih Konukoğlu, Inegol (TR); Erdogan Baris Özden, Inegol (TR); Şeref Ağzikara, Inegol (TR); Ertuğ Erkuş, Inegol (TR); Mustafa Zeyrek, Inegol (TR); Eşref Tuncer, Inegol (TR); Sedat Demirbüken, Inegol (TR); Erkan Evran, Inegol (TR)

(73) Assignee: SANKO TEKSTIL ISLETMELERI SAN. VE TIC. A.S., Inegol-Bursa (TR)

( * ) Notice: Subject to any disclaimer, the term of this patent is extended or adjusted under 35 U.S.C. 154(b) by 0 days.

(21) Appl. No.: 16/524,635

(22) Filed: Jul. 29, 2019

(65) Prior Publication Data

US 2020/0056307 A1 Feb. 20, 2020

(30) Foreign Application Priority Data

Jul. 27, 2018 (EP) ..... 18186138

(51) Int. Cl.
*D02G 3/36* (2006.01)

(52) U.S. Cl.
CPC ..... *D02G 3/36* (2013.01)

(58) Field of Classification Search
None
See application file for complete search history.

(56) References Cited

U.S. PATENT DOCUMENTS

| | | | | |
|---|---|---|---|---|
| 3,367,095 | A | 2/1968 | Field, Jr. | |
| 4,024,895 | A | 5/1977 | Barron | |
| 4,134,882 | A * | 1/1979 | Frankfort | D01F 6/62 264/210.8 |
| 4,343,334 | A | 8/1982 | Schulze et al. | |
| 5,531,063 | A * | 7/1996 | Sawhney | D01H 13/04 19/244 |
| 2008/0299855 | A1 | 4/2008 | Wenderoth et al. | |
| 2008/0318485 | A1 | 12/2008 | Cheng | |
| 2010/0256319 | A1 * | 10/2010 | Pereira De Lacerda | D01D 1/106 528/308.1 |
| 2012/0079802 | A1 * | 4/2012 | Yenici | D02G 3/26 57/211 |
| 2013/0260129 | A1 * | 10/2013 | Agzikara | D02G 3/326 428/221 |

FOREIGN PATENT DOCUMENTS

| | | | |
|---|---|---|---|
| BR | 102016017037 | * | 1/2017 |
| EP | 2 873 758 | | 5/2015 |

(Continued)

OTHER PUBLICATIONS

Machine translation of BR102016017037 (Year: 2017).*

(Continued)

*Primary Examiner* — Shawn Mckinnon

(57) ABSTRACT

A yarn (1) having a core (2) and a sheath (3), preferably comprising staple fibers, said core comprising at least one polymeric core fiber (21), preferably a plurality of polymeric core fibers (21), wherein the amount of the core fibers (21) is at least 35% by weight of the total weight of the yarn (1) and said core (2) and said sheath (3) are spun together.

25 Claims, 10 Drawing Sheets

(56) References Cited

FOREIGN PATENT DOCUMENTS

| | | |
|---|---|---|
| EP | 3208371 | 8/2017 |
| GB | 809 321 | 2/1959 |
| JP | H06 346332 | 12/1994 |
| JP | 2012 219405 | 11/2012 |
| WO | 96/18762 | 6/1996 |
| WO | 2012/062480 | 5/2012 |
| WO | 2015/081592 | 6/2015 |

OTHER PUBLICATIONS

International search report issued issued by the EPO on Aug. 28, 2019 for PCT application No. PCT/EP2019/070395.
European Search report issued by the EPO on Sep. 19, 2019 for EP application No. 19188944.
Oerlikon, "Unveiling the Basics of Draw Texturized Yarn" from the Internet on Oct. 10, 2023.
Dr. Mohammed Irfan, "Difference between POY, FDY and DTY Yarns" from the Internet "Difference between POY, FDY and DTY yarns (sootter.com)" on Oct. 10, 2023.

* cited by examiner

YARN COMPRISING A CORE AND A SHEATH OF FIBERS

This non-provisional application claims priority to and the benefit of European Application No. EP 18186138.6 filed on 27 Jul. 2018, the content of which is incorporated herein by reference in its entirety.

FIELD OF THE INVENTION

The present invention relates to composite yarns comprising a core and a sheath of fibers that covers the core fibers. In greater detail, the invention relates to yarns having a core and a sheath of fibers, the core includes fibers of a polymeric material; the fibers of the core may include elastic filaments and may be consisting of polymeric material. The yarns of the invention find application in particular in the production of casual, sport and comfort garments, including denim garments.

BACKGROUND OF THE INVENTION

Yarns having a core including polymeric filaments are known in the art. EP 3208371 discloses a yarn having a core that includes at least one elastic performance filament, most preferably a spandex and/or a lastol filament, and an inelastic control filament formed of a textured polymer or copolymer of a polyamide, a polyester, a polyolefin and mixtures thereof. According to EP'371, the textured control filament is loosely wrapped around the elastic filament.

US 2013/0260129 in the name of the present applicant, discloses a stretch yarn having a composite stretchable core and a cotton fibres sheath. The stretchable core comprises first and second filaments that each have different elastic properties, the first filament is an elastomer and the second filament is a polyester based (co)polymer with limited elasticity; the second, polyester based (co)polymer fiber is in the range of 60-90% (w/w) of the stretchable core.

US 2008/0318485 discloses core spun yarns with bi-component polyester filaments and an elastomeric fiber; to avoid grinning through of the elastic core, the polyester filaments include poly (trimethylene terephthalate) and either poly (ethylene terephthalate) or poly (tetramethylene terephthalate) and the elastomeric fiber is comprising spandex. The bi-component polyester filaments are drafted at a ratio of 1.01 to 1.30 and the elastomeric fiber is drafted at a ratio of 2.50 to 4.50 times the original length.

US 2008/0299855 discloses a core yarn having a textured monofilament core and a staple fiber sheath. The core has 2 to 20 denier and is twisted with the staple fibers.

A problem with known yarns, especially stretch yarns, having composite elastic core is that the amount of the components of the core in the final yarn has to be kept low to avoid the core becoming visible, i.e. surfacing, through the sheath of fibers. This requirement results in the use of high amounts of staple fibers, particularly of cotton fibers, which is a cost. A related problem is that the high amount of fibers used in the sheath requires the use of a certain number of long fibers, which is expensive. Also, the use of highly twisted short fibers may result in the yarn to become "curly", i.e. provided with undulations; this would in turn provide an unsatisfactory appearance to the fabric obtained from the yarn.

Another problem with the yarns of the known art is that the use of cotton is not environmentally-friendly, as it is needed a high amount of water in cotton growing, and also a high amount of water and energy is needed to dye cotton.

SUMMARY OF THE INVENTION

It is an aim of the present invention to solve the above mentioned problems and provide yarns and fabrics with a synthetic core having excellent appearance and possibly also good or great elasticity, should elasticity be required.

A further aim is to provide a yarn having a synthetic core that is completely covered by the fibres sheath, preferably a sheath of cotton fibres, and a fabric and garment using said yarn, without the core surfacing through the fibres, especially during or after use of the fabric or garment.

A further aim is to provide a yarn that is environmentally-friendly and inexpensive to manufacture.

Another aim of the invention is to provide a yarn, and a fabric, having a soft hand and that is comfortable for the user. A further aim is to provide a yarn that is environmentally-friendly and inexpensive to manufacture.

These aims are obtained by means of the present invention as claimed in one or more of the enclosed claims.

In particular, the present invention relates to a yarn, and article and a method according to the independent claims. Preferred aspects are mentioned in the dependent claims.

According to the invention, the yarn has a synthetic core comprising at least one, preferably plurality of fibers, said fibers preferably being non-texturized filaments and being present in an amount of at least 35% by weight on the total weight of the yarn. Preferred embodiments are object of the dependent claims.

Further objects of the invention are a fabric, particularly a denim fabric, containing a yarn as above defined and a garment or an article containing said fabric.

The invention also relates to a method of producing a stretch yarn according to claim 15, said method comprising the steps of: providing a core of polymeric core fibers, preferably non-texturized filaments, providing a plurality of staple fibers, spinning together said filaments and said staple fibers to cover said core with a sheath of fibers, wherein the amount of the said core fibers in the core is at least 35% by weight of the total weight of the yarn and by spinning said core and said sheath fibers. In an embodiment, in the spun yarn, a portion of at least part of the fibers of the sheath are held by said core fibers.

The core fibers preferably consists of non-elastomeric fibers. Elastomeric filaments can be added to the core and combined with the non-elastomeric core fibers. The above percentages of the core fibers thus refer only to the non-elastomeric fibers that are present in the core. In other words, the non-elastomeric fibers that are present in the core are at least 35% by weight of the total weight of the yarn.

As a result, according to possible embodiments, the core may comprise non elastomeric core fibers and further elastomeric filaments.

In other words, the "core fibers" typically consist of non-elastomeric fibers (typically continuous fibers), Non elastomeric fibers may still have elastic properties. As a result, the core of the composite yarn may comprise filaments with elastic properties, that can be the the non-elastomeric filaments (i.e.continuous core fibers) that are part of the core fibers, as well as elastomeric filaments.

With the wording "filaments having elastic properties" it is meant elastomeric filaments such as the filaments in elastane or spandex, and elastic non-elastomeric filaments (e.g. T400 filaments). Suitable elastomeric filaments have an elongation at break higher than 200%, preferably higher than 400%, typically comprised between 200% and 600%. The amount of elastomeric filaments may be in the range of 1%-20%, more preferably 1.5% to 10% of the total weight of the yarn. Filaments having elastic properties may be combined together. Preferred elastomeric filaments are elastane, polyurethane urea based fibers, lastol, Dow XLA. The filaments having elastic properties may be non-elastomeric filaments, preferably having elongation at break comprised between 15-50%. Preferred fibers for elastic non-elastomeric filaments are T400 (co-polymer of Polyester, elasto-multiester), PBT fibers, and other conjugate yarns such as PBT-PTT, PET-PTT and PET-PTMT. Total amount of filaments having elastic properties is 1-60% of the weight of the composite yarn, preferably 10-45%.

The above mentioned Elongation at break of non-elastomeric filaments may be measured with DIN ISO 2062, while elastomeric filaments may be tested with BISFA, test method for bare elastane yarns, Chapter 6. Non elastomeric filaments have recovery of at least 80%, preferably 93%, most preferably at least 96% or 97% or higher of the fiber". Recovery is measured with DIN 53835 part 3, with 0.2 cN/tex force and 3% elongation.

The elastomeric filaments suitable for use in the present invention are commercially available, e.g. under the trade mark Lycra, usually in the form of several filaments that have been extrude in a one-piece bundle of filaments attached together. In a preferred embodiment the elastomeric filaments are provided as a bundle of separated single filaments. More details on this type of elastomeric filaments are disclosed in co-pending applications EP19169983.4 as filed in the name of the present applicant. In brief, according to an aspect, a composite yarn comprises at least two single elastic filaments. With the definition according to which the elastic filaments are single, it is meant that they are not part of the same elastic bundle of continuously connected filaments. It is in fact known that for elastic textile elements, an amount of filaments may be bundled together to produce the desired thickness. It is e.g. known that a yarn of spandex is a bundle of filaments, as spandex yarns may be composed of a plurality smaller individual filament that adhere one another because of the natural stickiness of their surface. On the contrary, with single elastic filament is meant a monofilament yarn. According to a possible aspect, the single elastic filaments may be initially packaged in bundle, loosely coupled one to the other, so as to be separated (and become "single filaments") during subsequent process steps for producing a yarn.

Preferably, the core fibers are non-texturized filaments, that are typically flat, "flat" making reference to the non-texturized condition of the filament, and not to their section, that can be chosen as requested. In other words, the core of the yarn of the invention is free or substantially free from texturized filaments.

With the wording "spinning" or "twisting" it is indicated a known process of combining a core with a sheath of staple fibers. The process typically includes positioning the core fibers on or adjacent to a sliver or bundle of sheath fibers and twist the core with the fibers. Suitable twisting methods include e.g. ring spinning. Thus, a core and a sheath in the present invention are spun together e.g. by ring spinning.

Exemplary materials for the core fibers are polyester polymers and copolymers, namely PET (polyethylene terephthalate), PBT (polybutylene terephthalate), PTT (Poly tri-methylene terephthalate) PTMT (poly tetra-methylene terephthalate) or copolymer of polyester PTT/PET, PTT/PBT, PTMT/PET. Other suitable polymers are polyamides, namely nylon: PA6 (polyamide) PA 6.6 or copolymers of nylon, and polyacrylic and polyacrylonitrile polymers. In an embodiment provided with further elastomeric filaments, the core fibers are in the range of 90-98% by weight of the core. Preferred synthetic fibers for the core fibers are PP, PET, PA6, and PA6.6. The use of other synthetic materials for the core fibers, not explicitly mentioned in the above lists, is however not excluded.

Suitable staple fibers to be used for providing the sheath to the final yarn are known in the art and are e.g. cotton, rayon and its variation (Modal, Lyocell, Cupro, Viscose) linen, hemp, ramie, Kapok, wool, silk, cashmere, etcetera.

The core fibers can be continuous fibers (i.e. filaments) and also staple fibers, e.g. obtained by cutting filaments. The staple fibers may be mixed with continuous filaments. Preferred core fibers are e.g. the bundles of filaments known as FDY (Fully Drawn Yarns); known FDY fibers are e.g. obtained by drawing the polymer filaments exiting from the spinneret of the machine for producing the filaments. Preferred polymers for the FDY fibers are the above mentioned (co)polyesters and nylons.

An exemplary process to obtain FDY yarns is as follows. The raw material, typically PET chips are dried, melted, filtered and then distributed to spinning manifolds. In more detail, to manufacture FDY yarns, PET chips are fed into a dryer where the moisture is reduced from 0.30% to 0.0020%. After this, the chips are melted, filtered through polymer filter and extruded through the spinnerets. The extruder is electrically heated, at a controlled temperature (typically using a microprocessor). The extruder screw speed is also controlled and monitored very precisely to ensure uniform quality. The extruded filaments are cooled by filtered air in a quench chamber with precise temperature control. Air having no turbulence is used to ensure uniformity. High quality anti-static lubricating oil is applied to avoid static charges in the yarn. The yarn is taken by heated rollers (godets) to maintain residual elongation. Air punching may be carried out at regular intervals by intermingling nozzles and the yarn is finally wound on automatic winder. In the spinning process, a stretching effect can be obtained with a high degree of orientation filament winding and medium crystallinity.

In general, a flat, filament can be defined as a filament that has not been texturized; a flat filament used in the present invention undergoes a torsion during the spinning (or twisting) step and when removed from the yarn of the invention will no longer be completely flat. The filaments can be identified as a non-texturized filament because there is no false twist on them.

In an embodiment, the core fibers have a linear density of 14 denier or less, preferably 10 denier or less, more preferably the linear density is in the range of 0.2 to 9.9 denier. According to another aspect, the core fibers are continuous, i.e. they are core filaments, and the number of continuous core fibers (core filaments) in the core is at least 12, preferably at least 15 filaments per yarn; this number does not include the elastomeric filaments possibly present in the core.

In embodiments of the invention, the core fibers are continuous fibers, i.e. filaments, and the continuous core fibers and the elastomeric filaments are combined together in a known way, preferably by intermingling, or twisting or co-extrusion; these techniques are known in the art. The elastomeric filaments are drafted, or elongated, before being combined with the continuous core fibers. In an embodiment, the draft ratio of the elastomeric filaments is in the range of 1.5 to 5.5, more preferably 2.5 to 5.5. A preferred connecting technique is co-extrusion, also known as co-feeding; co-extrusion (co-feeding) of bundles of filaments is obtained by forcing (feeding together) the two (or more) bundles of filaments (in a tensioned state) through a restriction where the fibers are compressed together to such a degree that they remain attached also after exiting the restriction. A suitable restriction is e.g. a "V"-shaped roll; the fibers are fed to the roll and are fed together and forced into the bottom of the "V" where they are compressed together and remain bound. The co-extruded filaments are preferably spun with the fibers of the sheath immediately after the co-extrusion step.

In embodiments of the invention, the amount of the core fibers (excluding the elastomeric fibers) is at least 35% by weight of the total weight of the yarn, i.e. of the complete yarn including the sheath, and may be as high as 90% of the weight of the complete yarn. Preferably, the amount of core fibers is at least 37 or 38% by weight of the final yarn; preferably the amount of core fibers is in the range of 35% to 73% by weight of the final yarn, more preferably, the core is in the range of 37% to 53%, or 38% to 49%, of the weight of the yarn.

A first advantage of the claimed solution is that the yarn may have low twist multiple. According to exemplary embodiments, the twist level of the yarn may be dramatically reduced and twist multiples between 1.5 and 5.5, preferably between 2.0 and 3.5 may be used. It is even more preferred that the twist multiple be between 2.2 and 3.3, and even more preferable that the twist multiple be between 2.2 and 2.9. This low level twist results in a very soft fabric with excellent light reflection that is brilliant in color. The twist multiple may be obtained from the equation:

$$\text{Twist/inch} = \text{Twist Multiple} \times \sqrt{\text{English Cotton Number}}$$

where the value of twist per inch may be calculated with the equation $$\text{Twist/inch} = \text{spindle } rpm / \text{Yarn Delivery Speed}$$

Further details on low-twist yarns and their method of production are available e.g. in EP 3064623, in the name of the present applicant, the teaching of said document being hereto incorporated by reference.

By using low twisting, it is possible to provide a coarser yarn, with respect to the prior art, i.e. a yarn that is bigger in dimension with respect to the prior art, as shown in the following comparative example.

Three yarns were prepared. Yarn A was a yarn according to the invention, while yarns B and C were 100% ring spun cotton yarn according to the prior art. Data of the yarn is as follows.

| YARN | Ring yarn Twist Multiple | composition of yarn | YARN NUMBER NE | Yarn diameter (mm) |
|---|---|---|---|---|
| A | 2.5 | 60.5% COTTON 39.5% POLYESTER | 14/1 | 0.460 |
| B | 4.5 | 100% COTTON | 14/1 | 0.340 |
| C | 4.5 | 100% COTTON | 8/1 | 0.470 |

As visible, yarn A according to the invention has a greater diameter than yarn B, i.e. a common 100% cotton yarn having the same count of yarn A (i.e. 14/1 NE). The diameter of yarn A is similar to the one of yarn C, i.e. a common 100% cotton yarn that is heavier than yarn A (14/1 NE vs 8/1 NE).

Diameter of the yarns was measured with USTER TESTER 4.

The invention provides several further advantages over the prior art. A first advantage is that the yarn has a lower amount of cotton fibers than in a similar corresponding yarn according to the prior art. At the same time, the yarn of the invention has a very good appearance, substantially no surfacing of the core fibers, notwithstanding the higher amount of fibers used for the core. Additionally, it was found that it is possible to use a higher percentage of short fibers in the sheath than it is possible in the known art.

The amount of cotton used in the invention yarn is about 30-40% less than the amount of cotton required in a corresponding yarn according to the prior art. The reduction in the quantity of cotton fibers results in a plurality of advantages the first being the environmental sustainability of the yarn production process.

According to an aspect, the sheath may be 100% cotton. Other embodiments are possible where 10% to 90% of the sheath fibers are cotton fibers. The remaining part of the sheath may comprise other commercially available fibers. Cotton fibers may be regular cotton fibers, pre-consumer cotton fibers, or post-consumer cotton fibers. This results in saving water and in a greater sustainability of the yarn production.

Namely, the invention results in less sheath fibers (e.g. cotton) content, that results in saving water in cotton because less cotton is requires, hence less water is used in cotton growing, in a reduced use of dyestuff for dyeing process (because there is a lower amount of cotton, or similar sheath fiber to be dyed), and also in a drying process that is shorter and/or at lower temperatures. This means lower cost for the process, compared with the process for drying a traditional yarn containing almost 75-90% cotton.

As mentioned before, other fibers, different than cotton, can be used for the sheath. As an example, man made fibers (preferably cellulose-based) may be used, e.g. rayon and its variation (Modal, Lyocell, Cupro, Viscose). Natural fibers may be also used such as linen, hemp, rami, Kapok. According to a possible solution, animal fibers such as wool, silk, cashmere may be used as well.

Less energy is used in the drying process for a yarn according to the invention.

The invention also provides the following advantages in the production process.

In the ball warping step of the yarn production, the break ratio of the rope of the fabric can decrease by 10-20% per $10^6$ meters. Additionally, the amount of adhered pile is typically reduced by 5-10%. The figure of broken end sent to the rope dye may decrease by 5%.

In the rope dyeing step, the reduction in the amount of water to be used for dyeing the fabric can reach 30-45% by volume. Similarly, since the water pick-up amount of the yarn is lower, the amount of chemicals and dye to be used is reduced by 5-35% by weight, depending on the type of yarn.

The invention yarn has higher breaking strength, compared to a corresponding known yarn, having the same count, made from the same materials and having a higher percentage of cotton. For this reason, the rebeaming meter production can increase by 10-35%. The $10^6$ break ratio (i.e. the break ratio considered in the production of a million meter of yarns) can be reduced by 5-25% as a result of the higher yarn strength. Yarn to yarn friction will also decrease, which will reduce 15-30% of cotton-based breaks in reed region. Finally, the lost ends problem will be reduced because the yarn break decreases.

During sizing, yarn breakages that may occur in the sizing area due to yarn property can be reduced by 5-25%. With the reduction of the number breakages, the number of missing tips to the weaving section can be reduced by 10-20%. The amount of chemical used for the sizing step can also be reduced by 8-35%. The steam consumption to be used for yarn drying can be reduced by 30-50%. The fault score can decrease by 5-8% due to the decrease in flying fibers.

In particular, according to a preferred aspect, the composite core yarn is provided with a hairiness, that provide a soft feeling and "hand" to a fabric obtained with this yarn.

A possible way to measure hairiness is disclosed in ASTM 5647. Hairiness index according to ASTM5647 of the composite yarn is preferably comprised between 1 and 20, more preferably between 5 and 20.

According to a possible aspect, the tenacity of the composite yarn is comprised between 5 and 160 cN/tex, preferably between 10 and 25 cN/tex, more preferably less than 23 cN/tex, even more preferably less than 20 cN/tex. Tenacity is measured according to EN ISO 2062.

Elongation at break of the composite yarn is preferably comprised between 3% to 50%, more preferably for 15% to 35%, measured with EN ISO 2062.

Count of the composite yarn is preferably comprised between Ne 3/1 to Ne 100/1, more preferably between Ne 5/1 to Ne 80/1.

Total count of the core is preferably comprised between From 5 den to 1000 den, preferably from 50 den to 300 den.

Elongation at break of the core is preferably comprised between 5% and 160%, preferably between 10% to 50%.

A yarn of the invention may have a combination of the above features.

BRIEF DESCRIPTION OF THE DRAWINGS

The invention will be now further disclosed with reference to the following non-limiting figures, where.

DETAILED DESCRIPTION OF EXEMPLARY EMBDODIMENTS

Figure 1:
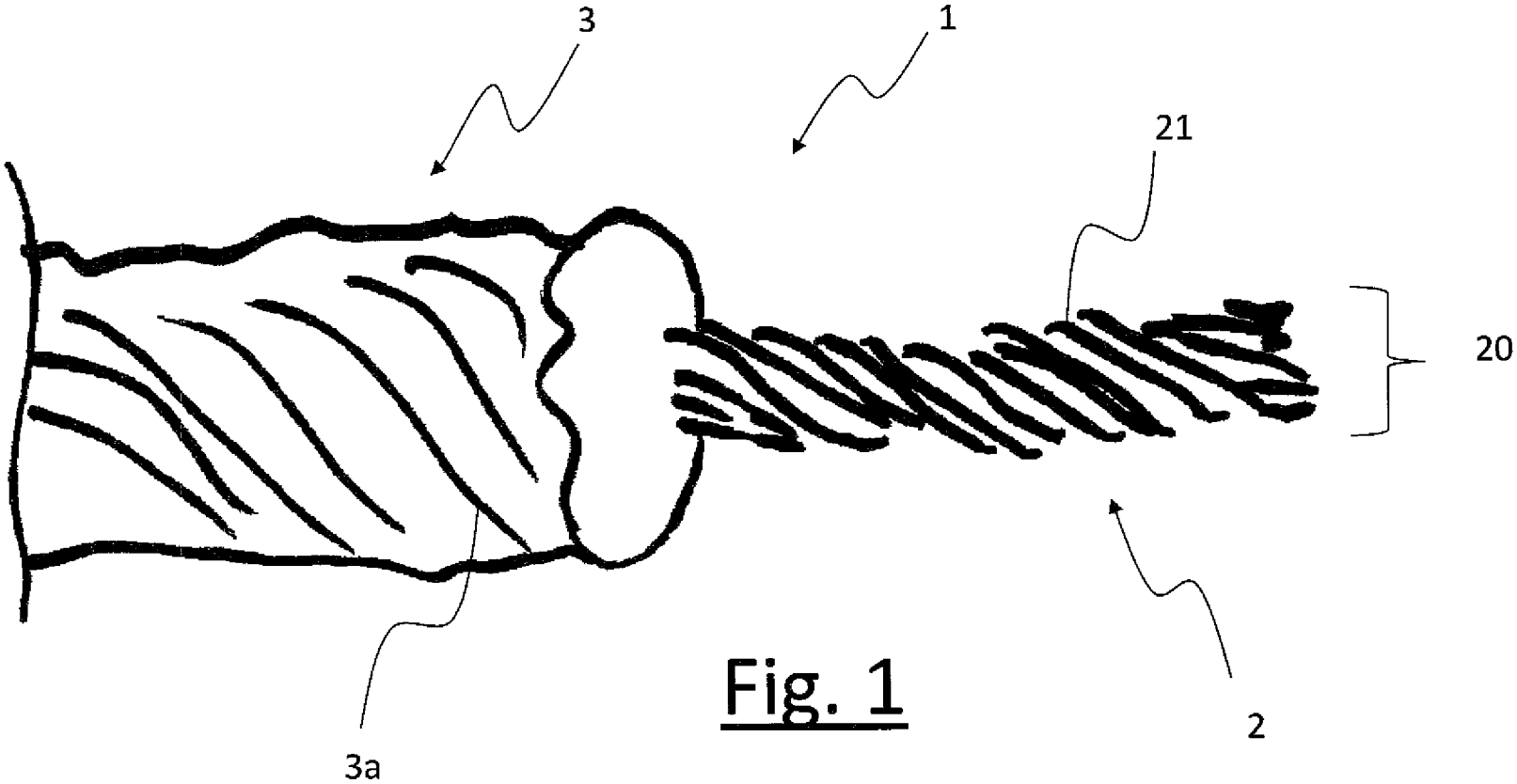
FIG. 1 is a schematic view of a composite yarn according to an embodiment of the present invention.

A composite yarn 1 has a core 2 and a sheath 3, typically comprising staple fibers 3*a*. The core 1 comprises at least one, preferably a plurality of core fibers 21. The core fibers 21 are preferably filaments (i.e. continuous endless fibers, e.g.as schematically shown in FIG. 1). In other embodiments, the core fibers 21 may comprise also (or consist in) staple fibers, e.g. obtained by cutting filaments. According to an embodiment, the core fibers 21 may comprise both continuous filaments and a bundle of staple fibers.

The linear density of the core fibers 21 is preferably 14 denier or less, more preferably 10 denier or less, even more preferably 0.2 to 8 denier. According to a possible embodiment, the denier of the core fibers 21 is comprised between 2 and 8 denier.

Preferred materials for the core fibers 21 are polyester polymers and copolymers. Other suitable polymers are polyamides. Exemplary materials for the core fibers 21 are polyester polymers and copolymers, namely PET (poly ethylene terephthalate), PBT (poly butylene terephthalate), PTT (Poly tri-methylene terephthalate) PTMT (poly tetramethylene terephthalate) or copolymer of polyester PTT/PET, PTT/PBT, PTMT/PET. Exemplary polyamides (namely nylon) are: PA6 (polyamide) PA 6.6 or copolymers of nylon, and polyacrylic and polyacrylonitrile polymers. The core fibers are typically non-elastomeric, i.e. they do not comprise an elastomeric yarn.

Suitable staple fibers 3*a* to be used for providing the sheath 3 to the composite yarn 1 are known in the art and are e.g. cotton, rayon and its commercially available variations (Modal, Cupro, Lyocell, Viscosa), linen, wool, hemp, ramie, Kapok, silk, cashmere and etcetera.

The amount of the core fibers 21 is at least 35% by weight of the total weight of the composite yarn 1. In embodiments of the invention, the amount of the core fibers 21 may be as high as 90% of the weight of the composite yarn 1. Preferably, the amount of core fibers 21 is at least 37% or 38% by weight of the final composite yarn; preferably the amount of core fibers is in the range of 35% to 73% by weight of the final yarn, more preferably, the core is in the range of 37% to 53%, or 38% to 49%, of the weight of the yarn.

In the embodiment schematically shown in FIG. 1, at least part of the core fibers may be provided as a bundle of fibers or as a core yarn 20, e.g a FDY yarn. Other embodiments are possible, e.g. embodiments where the core 2 comprises more than one bundle of fibers and/or yarn 20. Furthermore, the core fibers 21 may be a generic bundle of continuous core fibers that are not part of a FDY yarn. Preferably, according to an aspect, the core 2 comprises at least 1, more preferably at least 12, more preferably at least 15 continuous core fibers 21. The number of continuous core fibers (i.e. the number of core filaments) is also preferably less than 1160.

The total count of the core is preferably comprised between, 5 and 1000 den, more preferably between 50 and 300 den. Elongation at break of each core fiber 21 is preferably comprised between 15 and 50%, elongation at break of the core yarn is preferably comprised between 5% and 160%, more preferably between 10% and 50%.

According to a possible embodiment, the core 2 (and thus the composite yarn 1) is free from elastomeric fibers. In other words, the core 2 (and thus the composite yarn 1) essentially consist of non-elastomeric fibers. Some of these fibers may be elastic.

Figure 2:
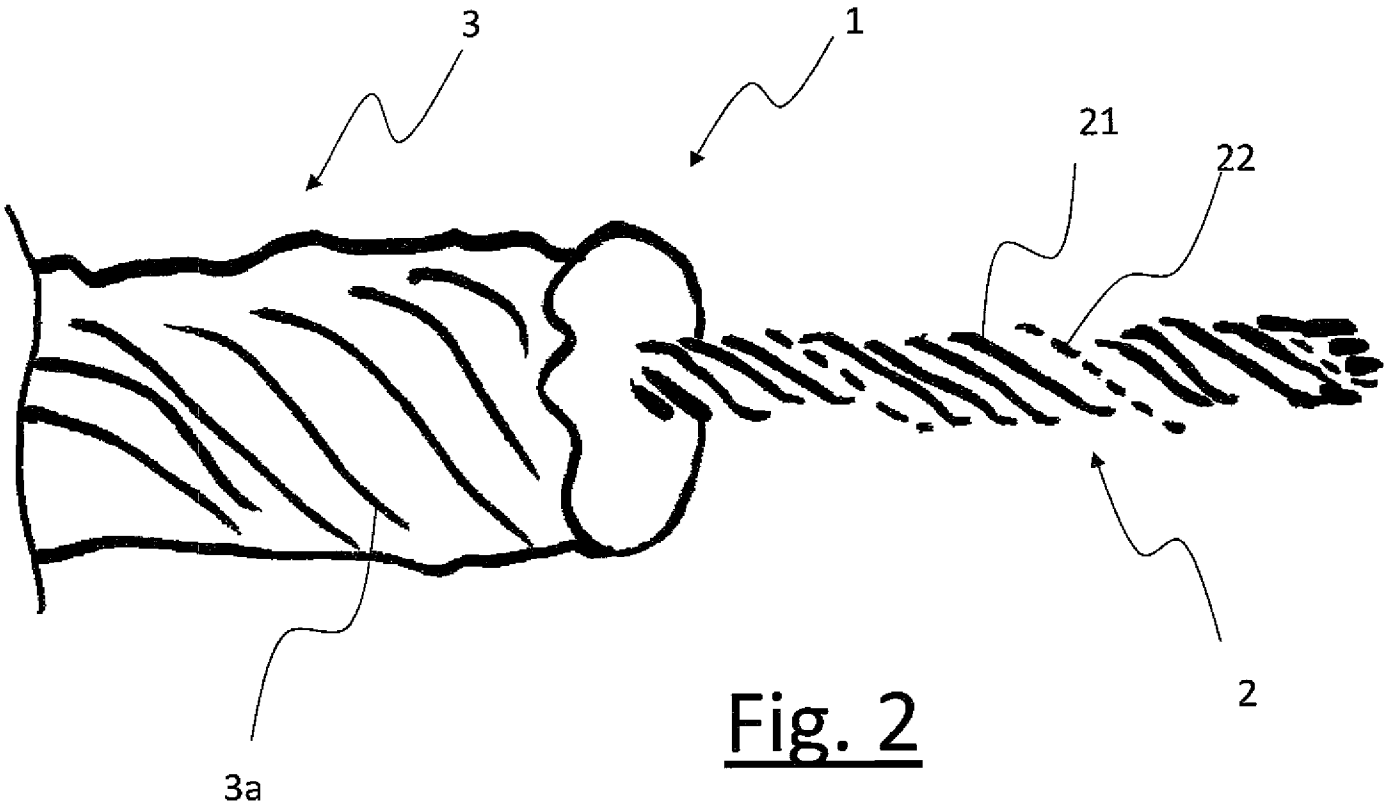
FIG. 2 is a schematic view of a composite yarn according to another embodiment of the present invention.

According to a different embodiment, the core 2 comprises at least one elastomeric filament 22 (shown in dotted line), as schematically shown in FIG. 2. According to possible embodiments, the core 2 of the composite yarn 1 comprises at least two single elastic filaments 22, i.e. at least two different monofilament yarns.

As previously mentioned, the above discussed percentages ("at least 35%", "at least 37% or 38%", "in the range of 35% to 73", etc.) of the core fibers 21 refer to the non-elastomeric fibers that are present in the core 2. In other words, the non-elastomeric fibers of the core 2 (i.e. the core fibers 21) are at least 35% of the total weight of the composite yarn. Preferred ranges were previously discussed ("at least 37% or 38%", "in the range of 35% to 73", etc.).

In embodiments of the invention, continuous core fibers 21 and the elastomeric filament(s) 22 are connected together at a plurality of points. Possible embodiments provide that the continuous core fibers 21 and the elastomeric filament(s) 22 are connected by intermingling, twisting or co-extrusion; these techniques are known in the art.

In view of the above, the core 2 may comprise different filaments having elastic properties. Filaments having elastic properties may be the elastic non-elastomeric core fibers 21, and, if present, the elastomeric filaments 22.

The total count of filaments having elastic properties is preferably comprised between 5 and 500 den, more preferably between 20 and 240 den.

Figure 3:
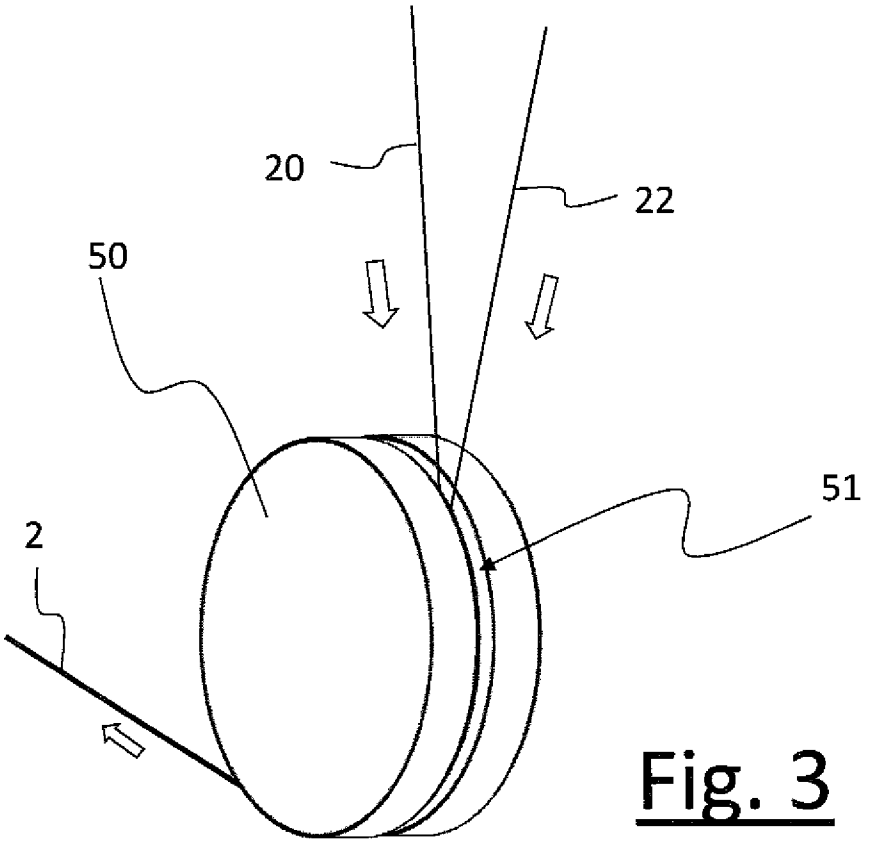
FIG. 3 is a schematic view of the "co-extrusion" method.
Figure 5:
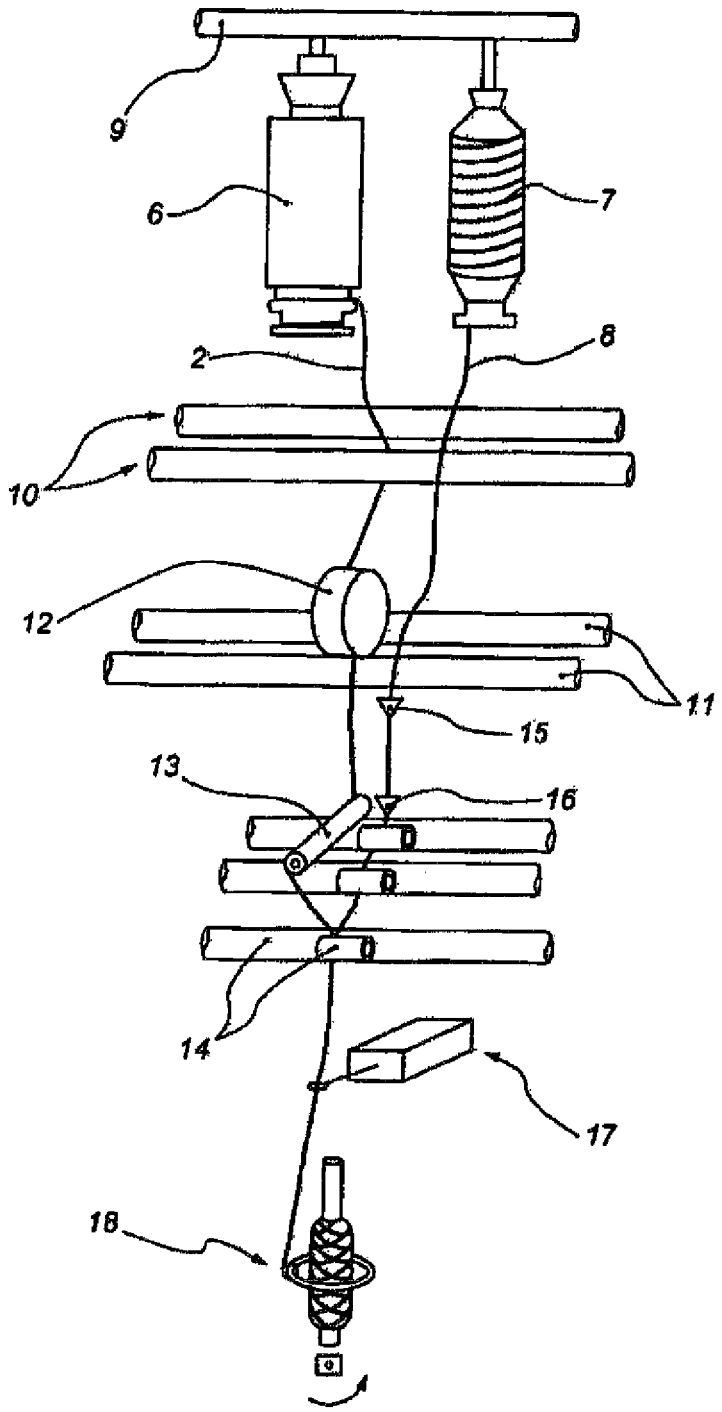
FIGS. 5 and 6 show a possible embodiment of an apparatus for the production of an exemplary composite yarn according to the invention.

FIG. 3 schematically shows the "co-extrusion" or "co-feeding" method for a bundle of fibers or core yarn 20 (e.g. an FDY yarn) and an elastomeric filament 22. The bundle of fibers or core yarn 20 and the elastomeric filament 22 are fed (preferably in a tensioned state) through a restriction 51 where they are pressed together and attach to each other to such a degree that they remain attached together also after exiting the restriction. In more detail, FIG. 5 shows a roll 50 having a "V"-shaped restriction 51; the bundle of fibers or core yarn 20 and the elastomeric filament 22 are fed to the roll 50 and are forced into the bottom of the "V" restriction 51, where they attach together, i.e. the bundle of fibers or core yarn 20 and the elastomeric filament 22 are connected together at least at a plurality of points, so that they exit the roll 50 as the substantially finished core 2, that may be covered by the sheath 3.

As previously discussed, a composite yarn 1 of the inventions is typically soft. A possible factor that may help in providing a soft feeling may be the yarn hairiness.

A possible way to measure hairiness is disclosed in ASTM 5647. Hairiness index according to ASTM5647 of the composite yarn 1 is preferably comprised between 1 and 20, more preferably between 5 and 20. As known, the hairiness index H corresponds to the total length of protruding fibers within the measurement field of 1 cm length of the yarn.

According to a possible aspect, the tenacity of the composite yarn 1 is comprised between 5 and 160 cN/tex, more preferably between 10 and 25 cN/tex, more preferably it is less than 23 cN/tex, even more preferably less than 20 cN/tex. Tenacity is measured according to EN ISO 2062.

Elongation at break of the composite yarn 1 is preferably comprised between 3% to 50%, more preferably for 15% to 35%, measured with EN ISO 2062.

The count of the composite yarn 1 is preferably comprised between Ne 3/1 to Ne 100/1, more preferably between Ne 5/1 to Ne 80/1.

In preferred embodiments, the composite yarn 1 is obtained via ring spinning. In particular, preferred embodiments provide that the composite yarn 1 is obtained by a core 2 that is coupled to a single roving (typically cotton roving). This provides a better centering (i.e. less grin through) of the core 2, and thus a softer and more appealing (in term of appearance) yarn. It is however possible to use two or more different rovings, as better discussed later.

Figure 6:
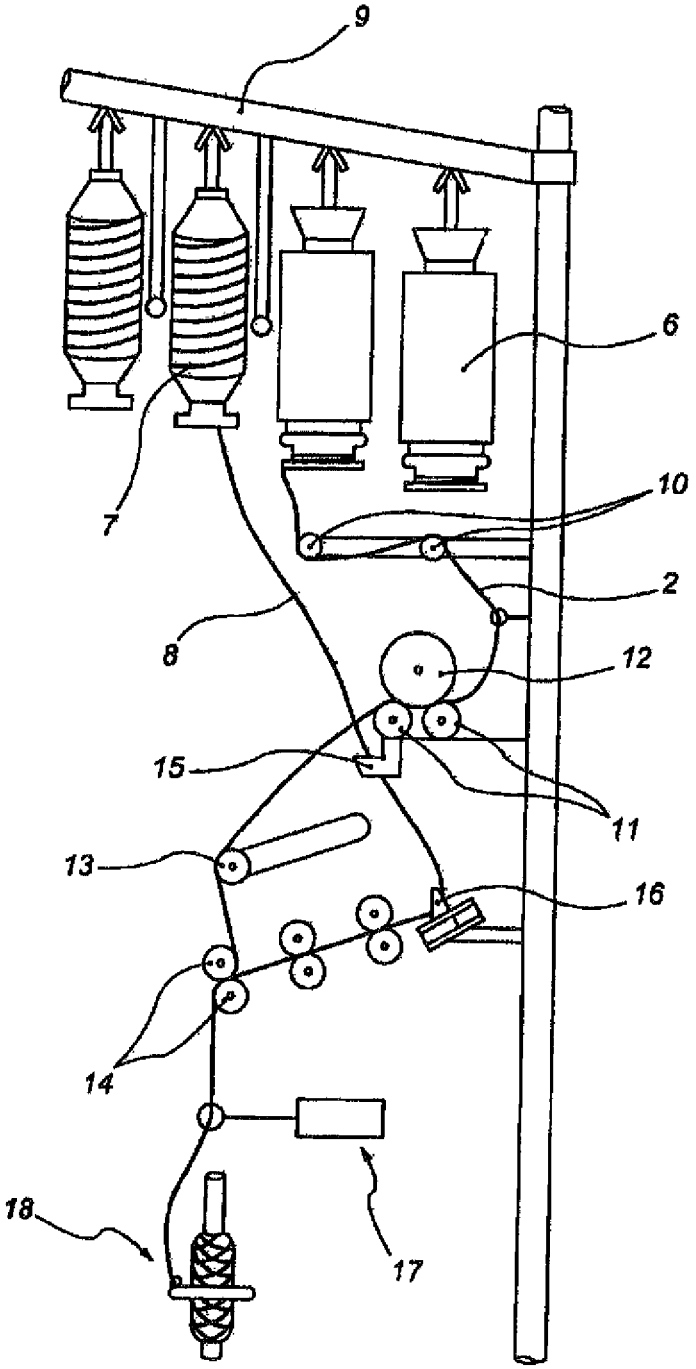

FIGS. 5 and 6 show an embodiment of a ring spinning apparatus for the production of an exemplary composite yarn 1 according to the invention.

The core 2 is taken from bobbin 6 and is guided between two tension bars 10 that are used to give a low pre-tension to the yarn, just to align and straighten core yarn 2. This is very useful when the core 2 is obtained by intermingling two different filaments. From pre-tension bars 10, core 2 is fed to two driving rollers 11 on which a weight 12 is placed; core 2 is guided between the driving rollers and the weight 12 to avoid free movement of the core yarn with respect to the rollers 11, however, other suitable means for imparting a controlled speed to the core yarn 2 may be used instead of the combination of rollers 11 and weight 12, e.g. means such as draft rollers that are known in the art.

The advantage of the above disclosed arrangement is mainly in the fact that the same apparatus can be used also to prepare a standard elastane core yarn: in this case the elastane fiber is loaded in a package that is placed on the rollers 11 in the place of weight 12.

From the first drafting arrangement 11, 12, core 2 (preferably a flat yarn, e.g. a bundle of filaments or a yarn 20) is guided to a rolling guide 13 and from it to draft rollers 14, that are the foremost couple of a plurality of drafting rollers for the cotton roving 8, known per se in the art.

Cotton roving 8 is guided from spool 7 in front of pre-tension rollers 10, tension rollers 11, into a first guide 15 and a second guide 16; as can be seen in FIG. 6, guide 15 is staggered to the front of the apparatus with respect to second guide 16 in order to create a tension in the roving and keep the roving in a fixed position, avoiding that the roving moves freely.

From guide 16, cotton roving 8 is sent to draft rollers 14. Draft rollers 14 are in common between core 2 and roving 8.

According to the invention, core 2 is tensioned before being coupled with the cotton roving, the tensioning or stretching is obtained by means of the speed difference between rollers 11 and rollers 14, i.e. the speed difference between rollers 11 and the last draft roller 14 create the draft ratio in composite core 2.

The above draft ratio is calculated as the ratio of the speed of rollers 14 vs. the speed of rollers 11, where the speed is the angular speed on the surface of the rollers.

It should be noticed that also pre-tensioning bars 10, contribute to obtaining the required draft ratio. The additional pretension bars 10 are useful in increasing the draft ratio because they provide an alignment and slight tension of the core 2, thus helping in the further stretch step. This results in the extreme accuracy with which the core 2 is kept in the center of the final yarn 1.

Use of additional guide 15 and its staggered position with respect of guide 16 also allow to feed the cotton roving always at the same position and to prevent the moving of cotton roving during the long run production. The combination of a better control in keeping the position of cotton roving 8 and a high tension on core 2 makes it possible to keep core 2 always in the center of the yarn 1 and to perfectly cover the core with staple fibers 3.

The two portions of final yarn 1 leaving draft rollers 14 are fed through guide 17 and spun together at spinning device 18, known per se in the art and comprising in one embodiment ring, traveler and spindle.

Any spinning method to produce a yarn 1 having a core 2 centered in a sheath 3 is within the scope of the present invention. Such methods include e.g. covered yarn system (using machinery by JCBT, Menegato, OMNI, RATT1, RPR, Jschikawa) or twisting machines (using machinery by Hamel, 2for1 by Volkman, SiroSpin by COGNETEX or Zinser).

The composite yarn produced can be used in production of elastic denim fabric and garments, especially as weft yarn. Machinery and methods of producing denim are well known in the art, as an example, Morrison Textile Machinery or Sulzer Machinery or modifications thereof may be used to produce a denim fabric with great elasticity and excellent stretch recovery.

Figure 7:
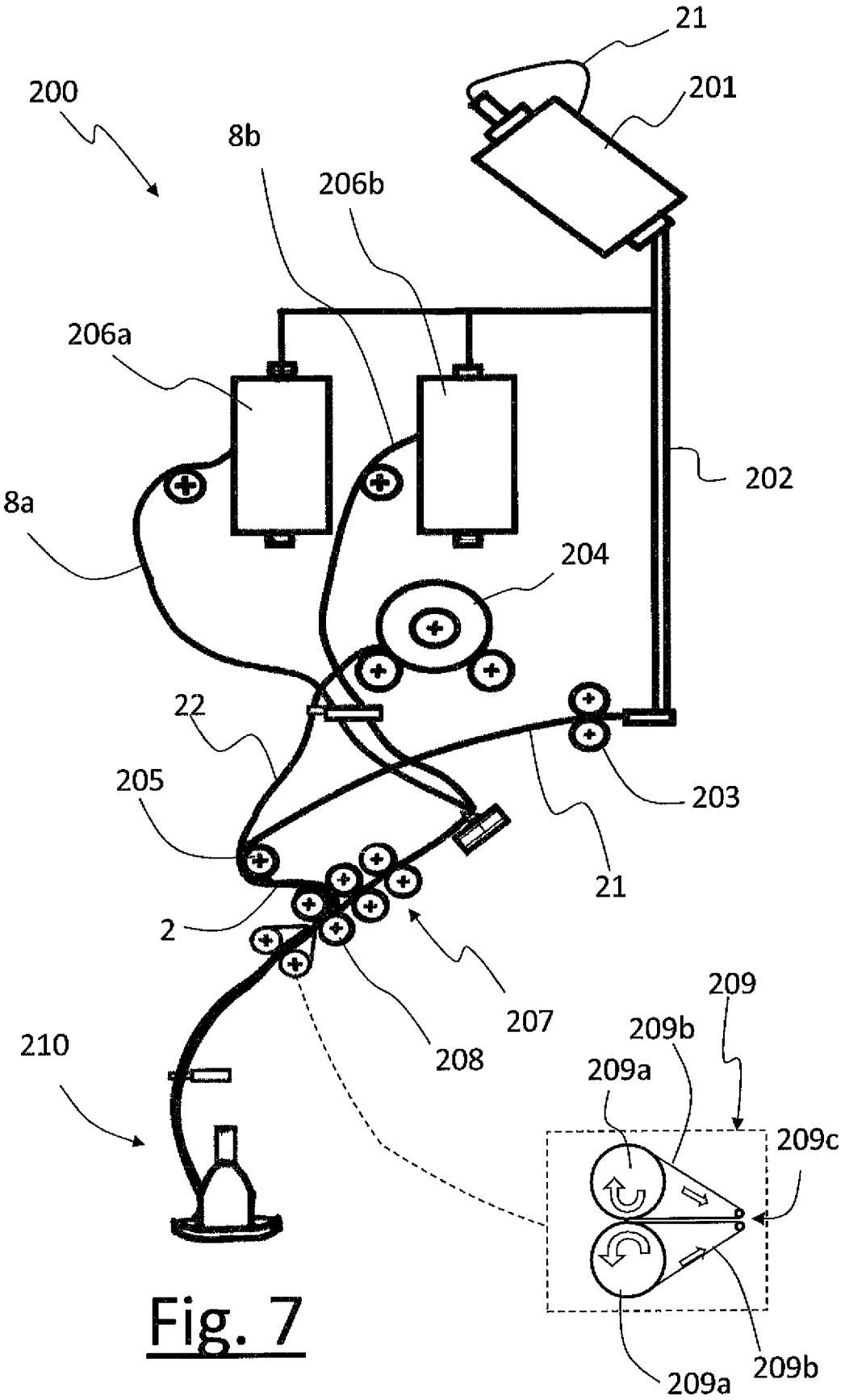
FIGS. 7 and 8 show another possible apparatus for the production of a composite yarn according to an embodiment of the present invention.
Figure 8:
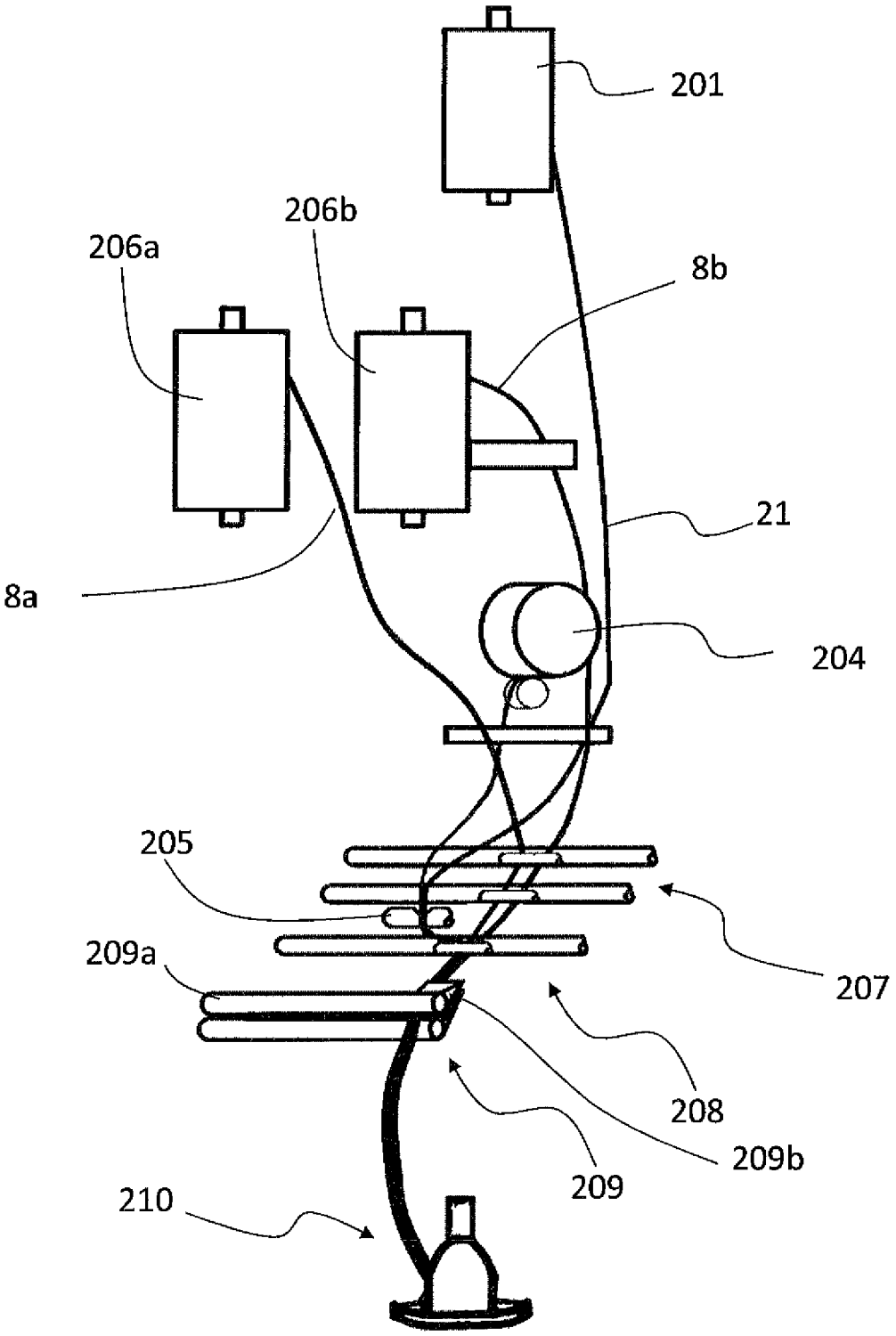

FIGS. 7 and 8 show another possible apparatus 200 and method for the production of a composite yarn 1 according to the present solution. In such an embodiment, the sheath 3 is made from two different rovings that, for part of their path, are treated separately, and subsequently combined to form the sheath. Similar methods are known in the art as "siro spinning". Further embodiment with a greater number of rovings are possible.

Core 2, comprises polyester filaments 21 and elastane as elastomeric filament 22. Polyester 21 comes from a bobbin 201, and is passed through a tube 202, where a first draft is applied. A further draft may be applied by rollers 203 at the exit of tube 202.

Elastane 22 comes from bobbin 204, and is guided to roller 205, where it is combined with polyester 21 to form the core 2. As an example, roller 205 may be of the kind shown in FIG. 3.

The sheath 3 is provided by two cotton rovings 8*a*, 8*b*, that come from spools 206*a*, 206*b*. Rovings 8*a*, 8*b* are drafted separately (as better shown in FIG. 8), e.g. by one or more draft rollers 207. Core yarn 2 is guided to draft rollers 208, where also cotton rovings 8*a*, 8*b* are fed.

The core yarns 2 and the cotton rovings 8*a*, 8*b* are then spun by a spinning device 210. Preferably, before the spinning device 210, the bundle of core yarn 2 and rovings 8*a*, 8*b* is passed through a further drafting and compacting device 209, shown in an exemplary and preferred embodiment in the enlarged detail of FIG. 7. In this embodiment, the drafting and compact device 209 comprises two compact rollers 209*a*, between which the bundle of yarns 2, 8*a*, 8*b* (not shown for better clarity in the enlarged detail of FIG. 7) is pressed. Each compact roller 209 drives an endless belt 209*b*. The belts 209*b* are facing one another, to define a passage 209*c* for the bundle of yarns 2, 8*a*, 8*b* between the belts 209*b*. This kind of drafting and compacting device is known in the art as "double apron drafting system".

In general, the bundle of yarns 2, 8*a*, 8*b* is guided and pressed by the drafting and compact device 209 (e.g. in the passage 209*c* by the belts 209*b* in the shown embodiment), providing an even pressing and drafting of all the components of the bundle of yarns 2, 8*a*, 8*b*, i.e. polyester 21 and elastane 22 of the core yarn 2 and the rovings 8*a*, 8*b* that form the sheath 3.

As before, the core 2 is drafted and guided in order to be centered with respect to the sheath 3 in the final yarn 1.

In other embodiments, the drafting and compacting device 209 may be omitted.

In addition, a possible embodiment provides that one of the two rovings 8*a*, 8*b* is omitted (or in any case not used), to carry out a single roving ring spinning of the composite yarn 1.

Figure 9:
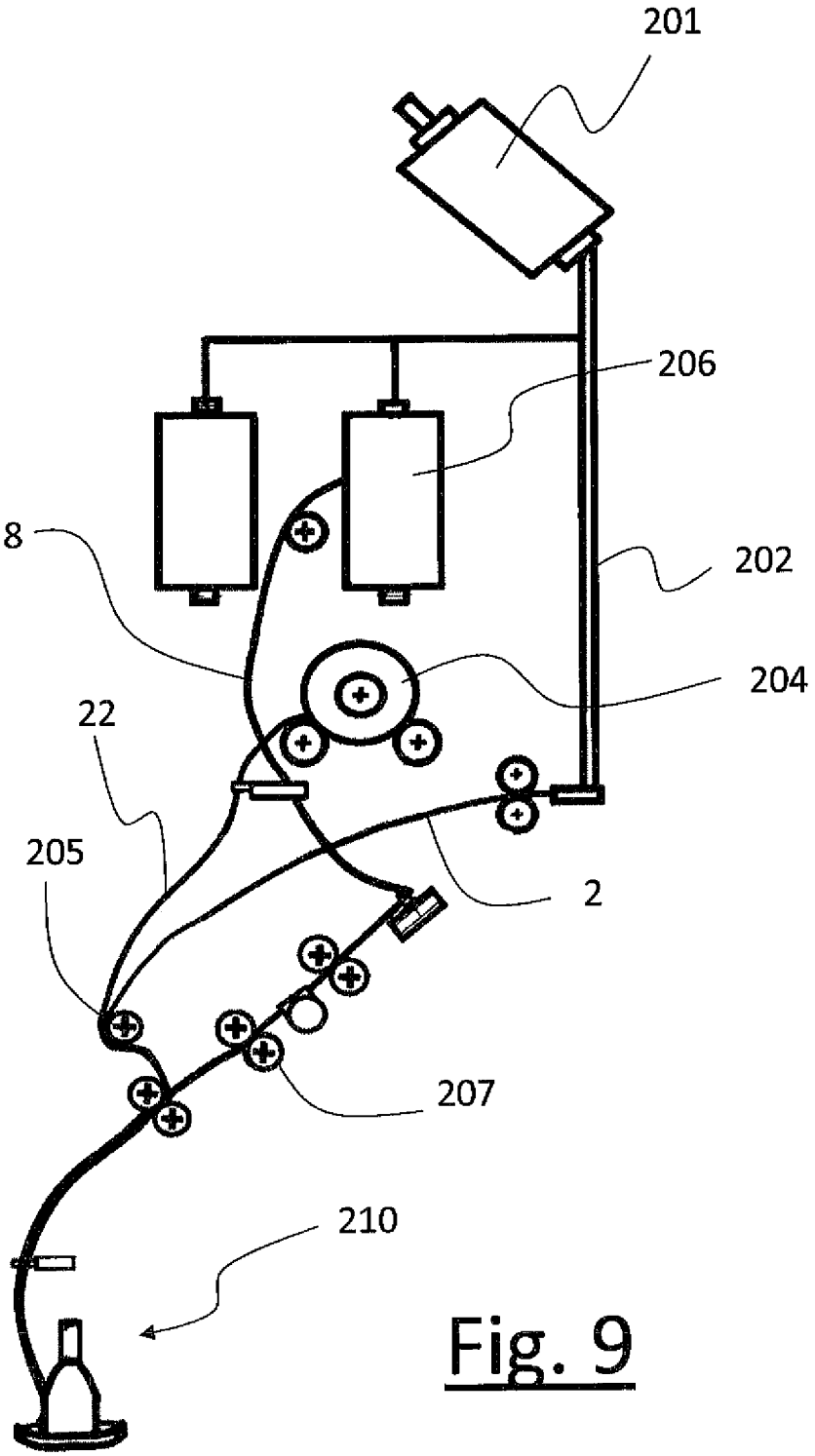
FIG. 9 shows a further possible embodiment of an apparatus for the production of an exemplary composite yarn according to the invention.

As an example, FIG. 9 shows an embodiment of a ring spinning apparatus, provided with a single source 7 for roving 8, and without a compacting device 209. The other elements are similar to the ones of FIGS. 7 and 8 and are shown with the same numeral references.

Figure 10:
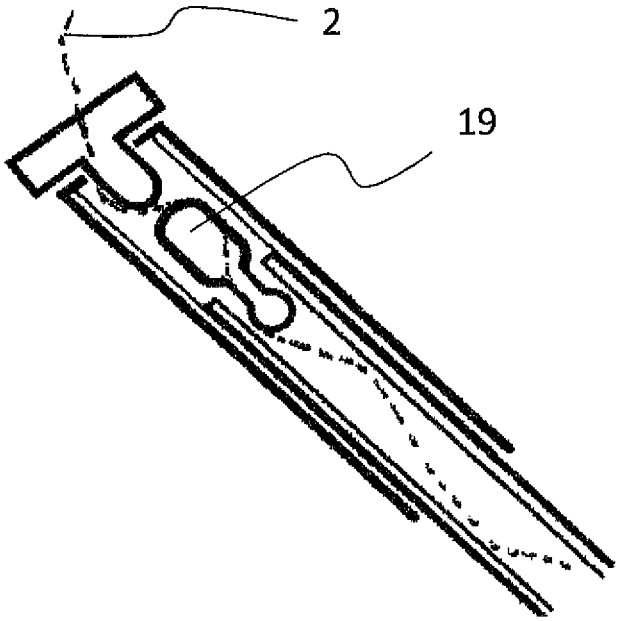

According to a possible embodiment, a brake element 19, schematically shown in FIG. 10, can be placed upstream the drafting means for the core 2, e.g. the brake element 19 can be placed within the tube 102, 202. The brake element 19 is an element that is contacted by the core 2 (e.g. the core 2 goes around the brake element 19, contacting its lateral surface), so that a force is applied to the core 2, by friction of the core 2 against the braking element 19, to adjust the speed of the core 2. The brake element 19 (or a portion of the brake element 19) can have a substantially cylindrical or prismatic shape, so that the core may slide against the lateral surface of the brake element 19.

Figures 4, 4A:
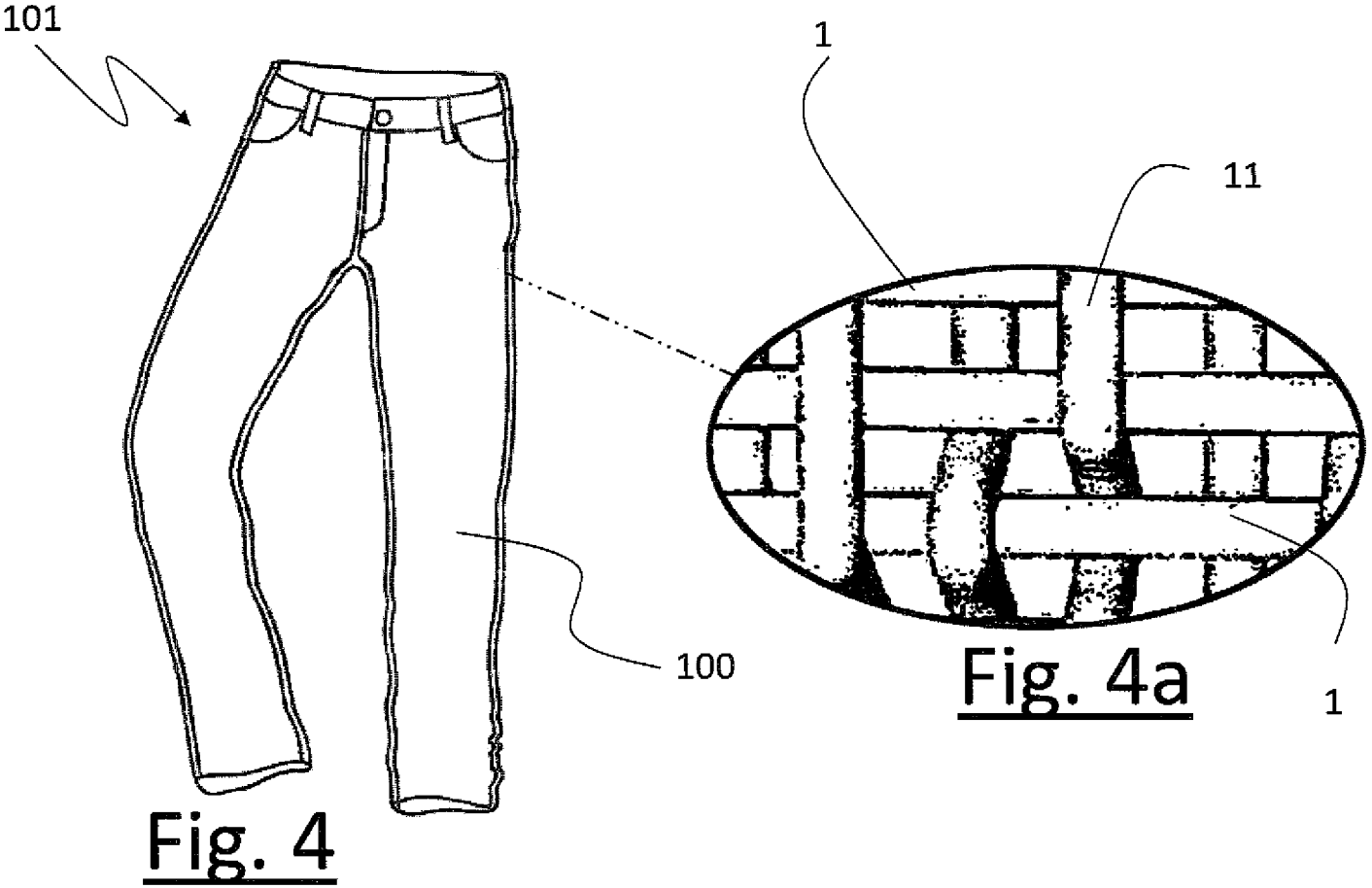
FIG. 4 is a schematic view of an article obtained with a fabric comprising composite yarns according to the present invention.
FIG. 4A is a schematic enlarged detail of FIG. 4.

The composite yarn 1 is typically used to produce a fabric 100. Such a fabric 100 may be used to produce an article 101, that is preferably a garment. As an example, in FIG. 4, the composite yarns 1 are used in a woven denim fabric 100, that is in turn used to produce a pair of trousers.

Different treatments can be carried out on the final fabric 100. In one embodiment, the fabric 100 can be embossed to obtain a three-dimensional design.

A chemical treatment can be applied to the fabric to dissolve (part of) the cellulose fibers to obtain a design or pattern on the fabric 100. This technique is known in the art as "burnout" or "devoré".

Particular effects on the final fabric 100 can be obtained by using different colours between the core fibers and the sheath fibers The invention will now be further disclosed with reference to the following examples.

The following ring yarns were prepared.

Yarn A—Warp yarn: Ne 14/1 64% Cotton, 36% FDY polyester filaments (PES)

Yarn B—Weft yarn: Ne 18/1; 47% Cotton, 46% FDY Polyester, 7% Elastane

The yarns were prepared by ring spinning a bundle of the PES continuous filaments with a sliver of cotton fibers. The core is a 150 denier bundle formed by 36 filaments; each filament is a 4.5 denier filament. No grin through of the core fibers through the fiber sheath was detected.

Example 1

Two fabrics, X1 and X2, were prepared using yarns according to the invention and a comparison yarn, Xcomp, was prepared using yarns according to the prior art. The composition of the sample weft yarns is recited in Table 1 under the Yarn Composition column. The composition of the warp yarns is the same as the composition of the weft yarns except that no elastane is present and the cotton amount is increased by the previously present elastane amount. The PES core in the yarns of X1 and X2 is a 150 denier bundle formed by 36 filaments, each filament is a 4.5 denier filament. The warp and weft yarns were used to prepare a finished woven fabric having the following features:

Weft density: 20.35 Thread/cm; Warp Density: 42 thread/cm

Fabric trials were carried out to evaluate fabric tear and tensile strength. The test results are summarized in the following table; from the results, it is apparent that the fabric performance has increased by 20% or more.

TABLE 1

| | | Tensile Strength Test (kg) ASTM D5034 | | Tear Strength Test (g) ASTM D1424 | |
|---|---|---|---|---|---|
| sample | Yarn Composition (weight %) | Warp | Weft | Warp | Weft |
| X1 | 55.50% COTTON 2.50% ELASTAN 42% POLYESTER | 112.9 | 81.1 | 6530 | 4300 |

TABLE 1-continued

| sample | Yarn Composition (weight %) | Tensile Strength Test (kg) ASTM D5034 | | Tear Strength Test (g) ASTM D1424 | |
|---|---|---|---|---|---|
| | | Warp | Weft | Warp | Weft |
| X2 | 53.50% COTTON 2.50% ELASTAN 44% POLYESTER | 124.24 | 73.35 | 6950 | 4320 |
| Xcomp | 91.50% COTTON 2.50% ELASTAN 6% POLYESTER | 94.8 | 45.31 | 5880 | 4570 |

Example 2

In example 2 three samples of fabrics X1, X2 and Xcomp, prepared for example 1 were tested for their behaviour in the washing step.

The results are summarized in the following Table 2.

It can be appreciated that the decrease in the drying time with respect to Xcomp, is about 7% for sample X1 and more than 10% for sample X2; this surprising reduction in the drying time of the fabric is reflected in a reduction of the energy used for the drying step and results in an important saving of drying costs.

TABLE 2

| sample | drying times (minutes) | unwashed weight (gr) | washed weight (gr) | weight after drying (gr) | removed water (gr) |
|---|---|---|---|---|---|
| X1 | 27 | 77.1 | 166.3 | 76.5 | 89.8 |
| X2 | 26 | 76.3 | 143.6 | 75.5 | 68.1 |
| Xcomp | 29 | 73.9 | 159 | 81.3 | 77.7 |

The yarn according to the invention is also particularly suitable for use in sportswear products. In fact, another result of the reduction of the amount of cotton in the yarn is that a fabric including yarns according to the invention, on human body, can dry faster than regular cotton products. It is believed that one of the likely reasons for this technical effect is that the fabric according to the invention absorbs less sweat than a fabric made of cotton yarns and that therefore it is easier for the heat of the body to dry the garment's fabric.

The invention claimed is:

1. A composite yarn (1) having a core (2) and a sheath (3) comprising staple fibers, said core comprising at least one polymeric core fiber (21), wherein the amount of the polymeric core fibers (21) is at least 35% by weight of the total weight of the composite yarn (1) and said core (2) and said sheath (3) are spun together, wherein the polymeric core fibers (21) are non-elastomeric and non-texturized fibers having a linear density of 14 denier or less, wherein the core fibers comprise at least 12 filaments said core further comprising at least one elastomeric filament, the non-elastomeric core fibers and the at least one elastomeric filament being connected together via a co-extrusion step in which they are forced through a restriction, where the non-elastomeric core fibers and the at least one elastomeric filament are pressed together and attach to each other to such a degree that they remain attached together also after exiting the restriction, wherein at least part of the core fibers comprise a bundle of filaments comprising fully drawn yarns (FDY).

2. The composite yarn (1) according to claim 1, wherein the amount of core fibers (21) is in the range of 35% to 90% by weight of the yarn (1).

3. The composite yarn (1) according to claim 1, having tenacity comprised between 5 and 160 cN/tex.

4. The composite yarn (1) according to claim 1, wherein said core fibers (21) comprise core fibers (21) that are selected from polyester polymers and copolymers, polyamide polymers and copolymers, polyacrylic polymers, and mixtures thereof.

5. The composite yarn (1) according to claim 1, wherein the twist multiple of the yarn (1) is in the range of 1.2 to 5.5.

6. The composite yarn (1) according to claim 1, wherein the amount of fibers having elastic properties is in the range of 1% to 60% of the total weight of the yarn.

7. The fabric (100) or an article (101) including a composite yarn (1) according to claim 1.

8. A method of preparing a composite yarn (1) according to claim 1, comprising the steps of providing a core (2) of filaments (21), made of polymeric material, providing a plurality of staple fibers (3*a*), spinning together said core fibers (21) and said staple fibers (3*a*) to cover said core (2) with a sheath (3) of fibers, wherein the amount of said core fibers (21) is at least 35% by weight of the total weight of the yarn (1), wherein the core fibers (21) are non-elastomeric and non-texturized fibers having a linear density of 14 denier or less, wherein the core fibers comprise at least 12 filaments, said core further comprising at least one elastomeric filament, wherein at least part of the polymeric non-elastomeric core fibers is provided as fully drawn yarns (FDY), the non-elastomeric core fibers and the at least one elastomeric filament being connected together via a co-extrusion step in which they are forced through a restriction, where they are pressed together and attach to each other to such a degree that they remain attached together also after exiting the restriction, said FDY comprising a flat, non-textured yarn.

9. The method according to claim 8, wherein in said spinning step the yarn is provided with a Twist Multiple in the range of 1.2-5.5.

10. The method according to preceding claim 8, wherein the core (2) and the sheath (3), are combined by ring spinning.

11. The method according to claim 10, comprising one or two, or more roving sources for the sheath (3).

12. The composite yarn according to claim 4, wherein the core fibers (21) comprise one or more of:

PET (polyethylene terephthalate) filaments;

PBT (polybutylene terephthalate) filaments;

PTT (Poly tri-methylene terephthalate) filaments;

PTMT (poly tetra-methylene terephthalate) filaments;

filaments made of copolymer of one or more of PET, PBT, PTT, PTMT;

PTT/PET bicomponent filaments,

PTT/PBT bicomponent filaments;

PTMT/PET bicomponent filaments.

13. A composite yarn (1) having a core (2) and a sheath (3) comprising staple fibers, said core comprising a plurality of polymeric core fibers (21), wherein the amount of the polymeric core fibers (21) is at least 35% by weight of the total weight of the yarn (1) and said core (2) and said sheath (3) are spun together, wherein the polymeric core fibers (21) are non-elastomeric and non-texturized fibers, wherein the twist multiple of the yarn is in the range 1.2 to 5.5 and wherein at least part of the core fibers comprise a bundle of filaments comprising fully drawn yarns (FDY) and wherein the polymeric core fibers (21) are non-elastomeric and non-texturized fibers having a linear density of 14 denier or less.

14. A method of preparing a composite yarn, said method comprising:

providing a core comprising core fibers made of polymeric material, the core fibers comprising non-elastomeric and non-texturized fibers having a linear density of 14 denier or less and comprising at least 12 filaments, said core further comprising at least one elastomeric filament;

providing a plurality of staple fibers, drawing the core fibers from a spinneret to produce a bundle of fully drawn yarns (FDY);

connecting together the FDY bundle of core fibers and the at least one elastomeric filament via co-extrusion comprising forcing the core fibers and the at least one elastomeric filament through a restriction, where the core fibers and the at least one elastomeric filament are pressed together and attach to each other to such a degree that they remain attached together after exiting the restriction; and spinning together said core and said staple fibers to cover said core with a sheath of fibers, wherein the amount of said core fibers is at least 35% by weight of the total weight of the yarn.

15. The method according to claim 14, wherein said forcing comprises forcing the non-elastomeric core fibers and the at least one elastomeric filament through the restriction in a tensioned state.

16. The method according to claim 14, further comprising elongating said at least one elastomeric filament before said forcing.

17. A method of preparing a composite yarn, said method comprising:

providing a core comprising core fibers made of polymeric material, the core fibers comprising non-elastomeric and non-texturized fibers having a linear density of 14 denier or less and comprising at least 12 filaments, said core further comprising at least one elastomeric filament;

providing a plurality of staple fibers, drawing the core fibers from a spinneret to produce a bundle of fully drawn yarns (FDY);

connecting together the FDY bundle of core fibers and the at least one elastomeric filament via co-extrusion comprising forcing the core fibers and the at least one elastomeric filament through a restriction, where the core fibers and the at least one elastomeric filament are pressed together and attach to each other to such a degree that they remain attached together after exiting the restriction; and spinning together said core and said staple fibers to cover said core with a sheath of fibers, wherein the amount of said core fibers is at least 35% by weight of the total weight of the yarn and further comprising elongating said at least one elastomeric filament before said forcing and wherein a draft ratio of said elongating comprises a range of 4.5 to 5.5.

18. The method according to claim 14, further comprising:

drying, melting and filtering a plurality of PET (polyethylene terephthalate) chips;

distributing the PET chips to spinning manifolds;

melting the PET chips;

filtering the melted PET chips through a polymer filter; and delivering the melted PET chips to said spinneret.

19. The method according to claim 18, wherein said drawing the core fibers from a spinneret comprises extruding through the spinneret.

20. The method according to claim 18, wherein drawing the core fibers from a spinneret comprises passing the fibers through the spinneret.

21. The composite yarn according to claim 1, wherein said FDY comprises a flat, non-textured yarn.

22. The composite yarn according to claim 1, wherein the at least one elastomeric filament is in a stretched state when pressed together and attached to the non-elastomeric core fibers.

23. The composite yarn according to claim 13, wherein said FDY comprises a flat, non-textured yarn.

24. The method according to claim 8, further comprising elongating said at least one elastomeric filament prior to said forcing through a restriction such that the at least one elastomeric filament is in a tensioned state prior to said forcing.

25. A method of preparing a composite yarn (1) according to claim 1, comprising the steps of providing a core (2) of filaments (21), made of polymeric material, providing a plurality of staple fibers (3*a*), spinning together said core fibers (21) and said staple fibers (3*a*) to cover said core (2) with a sheath (3) of fibers, wherein the amount of said core fibers (21) is at least 35% by weight of the total weight of the yarn (1), wherein the core fibers (21) are non-elastomeric and non-texturized fibers having a linear density of 14 denier or less, wherein the core fibers comprise at least 12 filaments, said core further comprising at least one elastomeric filament, wherein at least part of the polymeric non-elastomeric core fibers is provided as fully drawn yarns (FDY), the non-elastomeric core fibers and the at least one elastomeric filament being connected together via a co-extrusion step in which they are forced through a restriction, where they are pressed together and attach to each other to such a degree that they remain attached together also after exiting the restriction, said FDY comprising a flat, non-textured yarn, said method further comprising elongating said at least one elastomeric filament prior to said forcing through a restriction such that the at least one elastomeric filament is in a tensioned state prior to said forcing wherein a draft ratio of said elongating lies within a range of 4.5 to 5.5.

* * * * *